US009974418B1

(12) United States Patent
Clarke

(10) Patent No.: US 9,974,418 B1
(45) Date of Patent: May 22, 2018

(54) BODILY WASHING ASSEMBLY

(71) Applicant: Marlene Clarke, Montreal (CA)

(72) Inventor: Marlene Clarke, Montreal (CA)

( * ) Notice: Subject to any disclaimer, the term of this patent is extended or adjusted under 35 U.S.C. 154(b) by 0 days. days.

(21) Appl. No.: 15/342,853

(22) Filed: Nov. 3, 2016

(51) Int. Cl.
*A46B 5/04* (2006.01)
*A47K 7/03* (2006.01)
*A47K 7/02* (2006.01)

(52) U.S. Cl.
CPC . *A47K 7/03* (2013.01); *A47K 7/02* (2013.01)

(58) Field of Classification Search
CPC ..... A47K 7/02; A47K 7/03
See application file for complete search history.

(56) References Cited

U.S. PATENT DOCUMENTS 2,210,754 A * 8/1940 Frank ..... A47K 7/02 15/227
5,953,250 A 9/1999 Hsu et al.
6,588,961 B2 * 7/2003 Lafosse-Marin ..... A47L 13/19 401/132
D571,067 S 6/2008 McClain
7,575,384 B2 * 8/2009 Bauer ..... A47K 7/03 401/7
7,647,667 B2 1/2010 Benjamin et al.
8,356,378 B1 * 1/2013 Crooms ..... A47L 13/19 15/104.94
8,469,619 B1 * 6/2013 Lewis ..... A46B 5/04 401/7
8,663,177 B1 3/2014 Fogel
8,898,848 B1 12/2014 Stevens
9,808,130 B2 * 11/2017 Bank ..... A47K 7/03
2005/0111897 A1 5/2005 Presniakov

* cited by examiner

*Primary Examiner* — Jennifer C Chiang

(57) ABSTRACT

A bodily washing assembly for inhibiting cross contamination between patients in a medical environment includes a mitt that is selectively worn on a hand. A cleaning unit is coupled to the mitt. The cleaning unit washes the user when the user wears the mitt. The cleaning unit contains a fluid soap. The fluid soap is selectively dispensed onto the user.

5 Claims, 4 Drawing Sheets

BODILY WASHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to washing devices and more particularly pertains to a new washing device for inhibiting cross contamination between patients in a medical environment.

BRIEF SUMMARY OF THE INVENTION

An embodiment of the disclosure meets the needs presented above by generally comprising a mitt that is selectively worn on a hand. A cleaning unit is coupled to the mitt. The cleaning unit washes the user when the user wears the mitt. The cleaning unit contains a fluid soap. The fluid soap is selectively dispensed onto the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
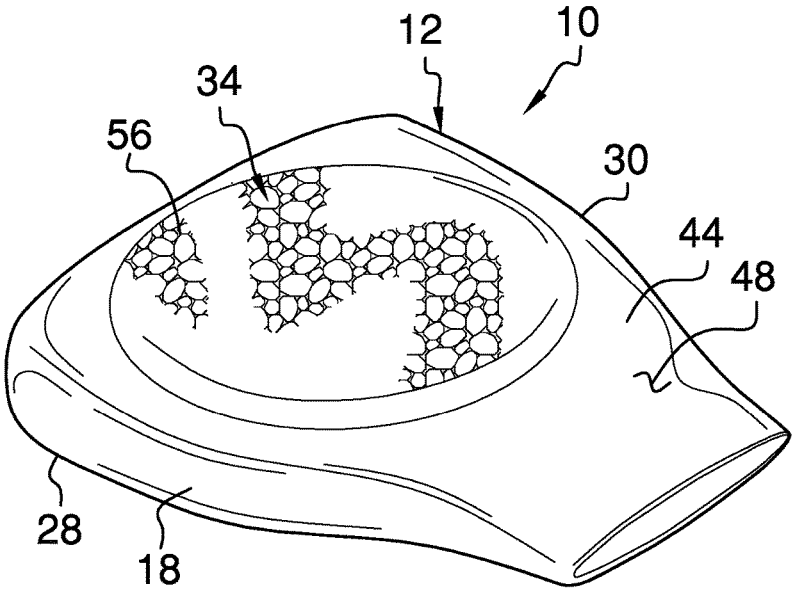
FIG. 1 is a top perspective view of a bodily washing assembly according to an embodiment of the disclosure.
Figure 2:
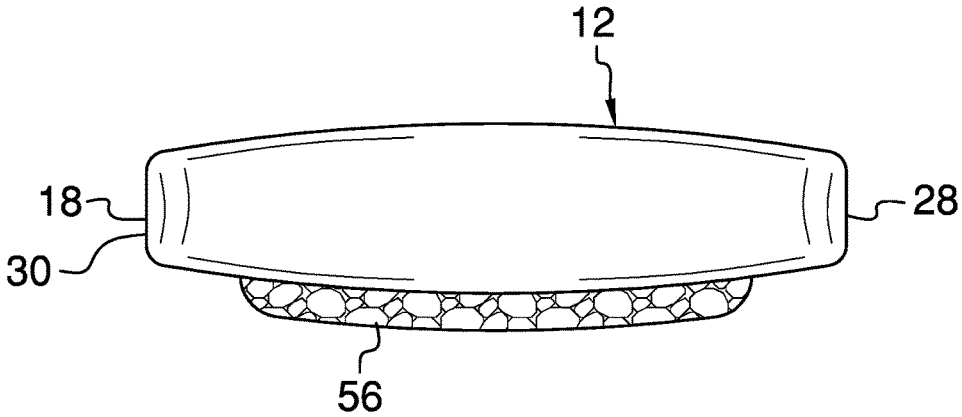
FIG. 2 is a front view of an embodiment of the disclosure.
Figure 3:
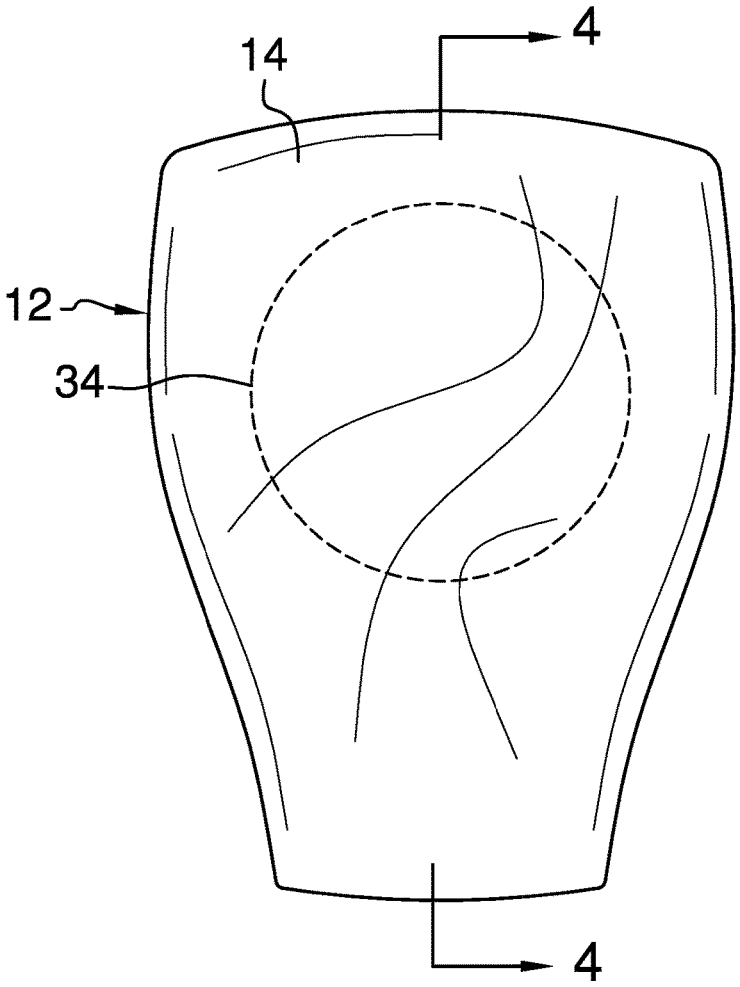
FIG. 3 is a top phantom view of an embodiment of the disclosure.
Figure 4:
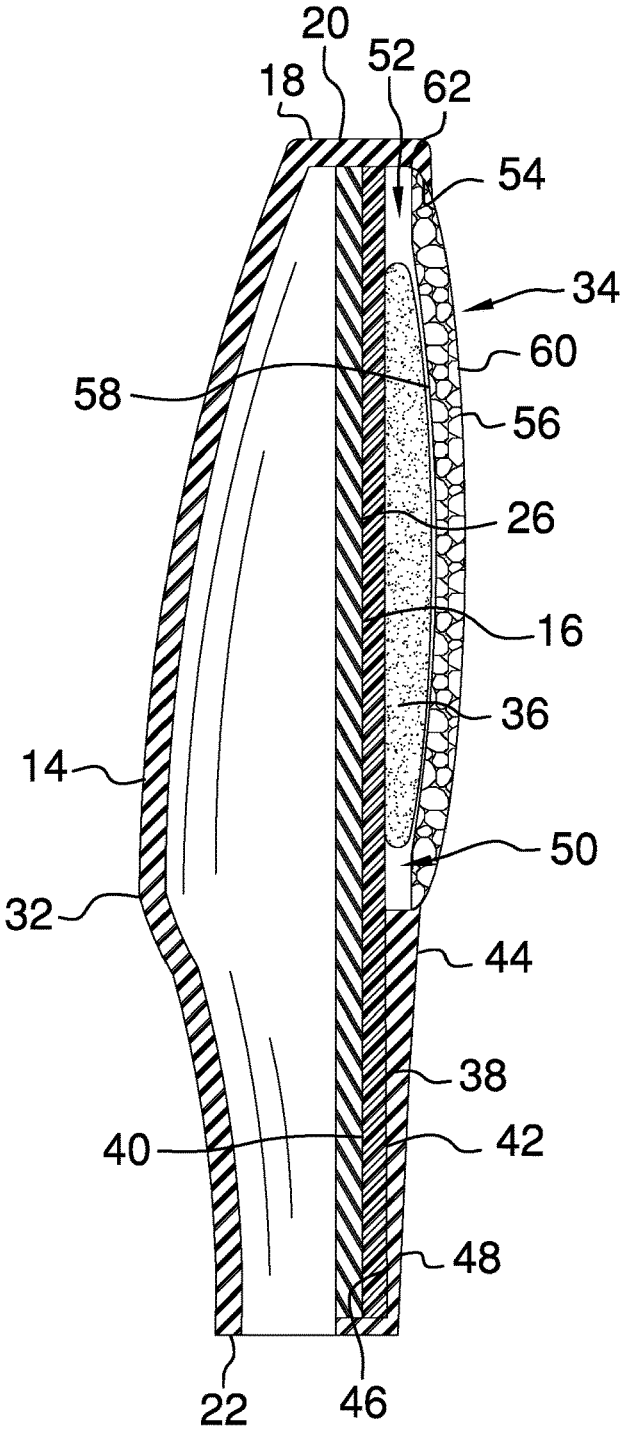
FIG. 4 is a cross sectional view taken along line 4-4 of FIG. 3 of an embodiment of the disclosure.
Figure 5:
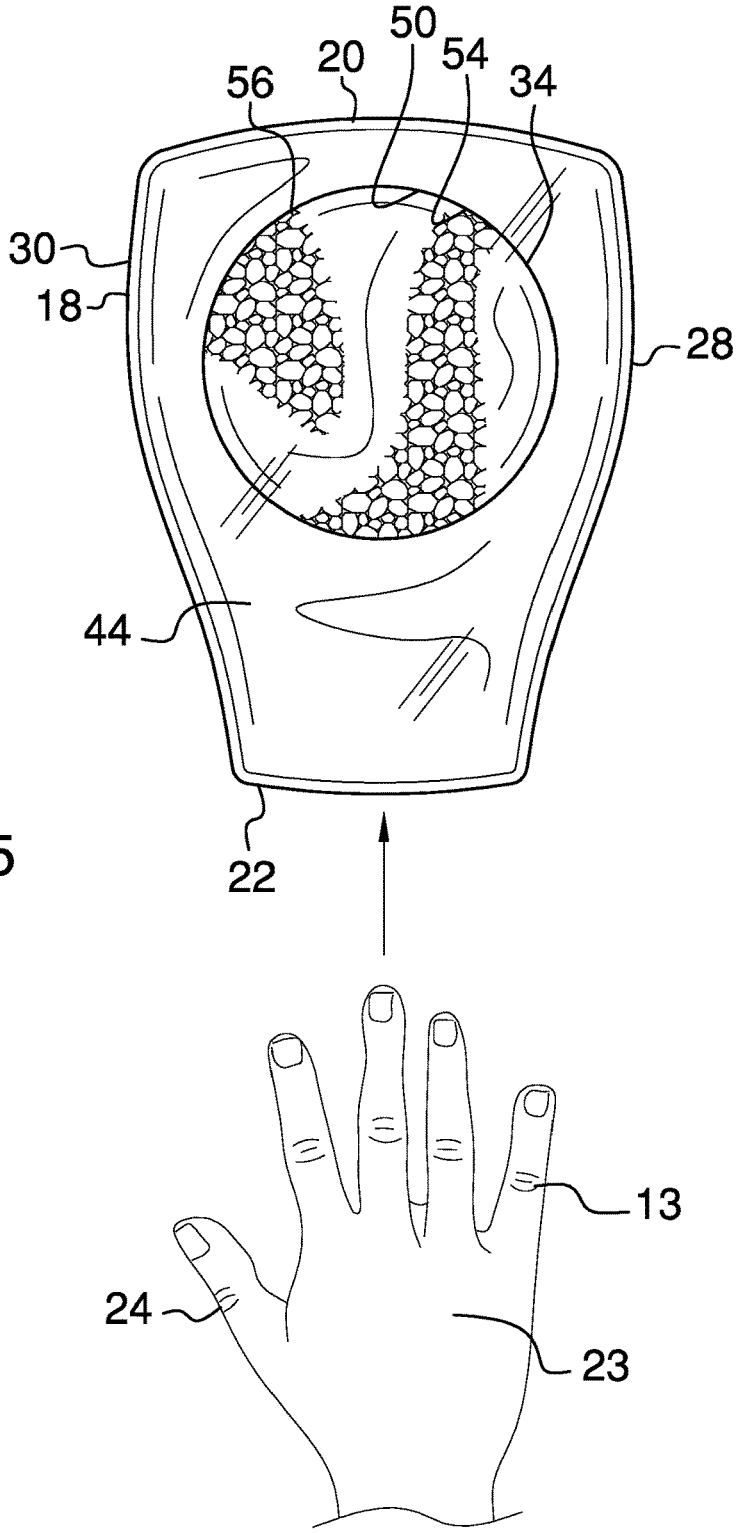
FIG. 5 is a bottom view of an embodiment of the disclosure.

With reference now to the drawings, and in particular to FIGS. 1 through 5 thereof, a new washing device embodying the principles and concepts of an embodiment of the disclosure and generally designated by the reference numeral 10 will be described.

As best illustrated in FIGS. 1 through 5, the bodily washing assembly 10 generally comprises a mitt 12 that may be worn on a hand 13. The mitt 12 has a top wall 14, a bottom wall 16 and a peripheral edge 18 extending therebetween. The peripheral edge 18 has a front side 20 and a back side 22. The back side 22 is open to insertably receive the hand 13 of a user 24. Moreover, the bottom wall 16 is positioned on a palm 23 of the user 24 when the mitt 12 is worn. The bottom wall 16 has an outer surface 26.

The peripheral edge 18 has a first lateral side 28 and a second lateral side 30. Each of the first lateral side 28 and the second lateral side 30 curve inwardly between the front side 20 and the back side 22 of the mitt 12. The top wall 14 has a peak 32 extending between the first lateral side 28 and the second lateral side 30. The peak 32 facilitates the user's 24 knuckles to fit between the top wall 14 and the bottom wall 16.

A cleaning unit 34 is provided. The cleaning unit 34 is coupled to the mitt 12. Moreover, the cleaning unit 34 washes the user 24 when the user 24 wears the mitt 12. The cleaning unit 34 contains a fluid soap 36. The cleaning unit 34 dispenses the fluid soap 36 dispensed onto the user 24. The mitt 12 may be worn in a hospital or other medical environment. Moreover, the fluid soap 36 is an anti-bacterial fluid soap.

The cleaning unit 34 comprises a sheet 38 that is coupled to the outer surface 26 of the bottom wall 16. The sheet 38 is coextensive with the bottom wall 16. The sheet 38 is comprised of a fluid impermeable material such as plastic or the like. Thus, the cleaning unit 34 is fluidly discrete with respect to the mitt 12. The sheet 38 has a first surface 40 and a second surface 42. The first surface 40 engages the outer surface 26 of the mitt 12.

A panel 44 is provided. The panel 44 has a primary surface 46 and a secondary surface 48. The primary surface 46 is coupled to the outer surface 26 of the sheet 38. The panel 44 is coextensive with the sheet 38. The panel 44 is comprised of a deformable material. The panel 44 may be coupled to the peripheral edge 18 of the mitt 12.

The panel 44 has an opening 50 extending through the primary surface 46 and the secondary surface 48 to define a soap space 52. The fluid soap 36 is positioned in the soap space 52. The opening 50 has a bounding edge 54. Moreover, the opening 50 is positioned closer to the front side 20 of the mitt 12 than the back side 22 of the mitt 12.

A sponge 56 is provided that has a first surface 58, a second surface 60 and an exterior edge 62 extending therebetween. The exterior edge 62 is coextensively coupled to the bounding edge 54 of the opening 50. The first surface 58 of the sponge 56 is spaced from the second surface 42 of the sheet 38. The fluid soap 36 is absorbed through the first surface 40 and the second surface 42 when the mitt 12 is worn. Thus, the sponge 56 selectively dispenses the fluid soap 36 onto the user 24.

In use, the mitt 12 is worn by either the user 24 or a caregiver in the medical environment. The mitt 12 is manipulated to wash the user 24. The fluid soap 36 passes through the sponge 56 when the sponge 56 is scrubbed on the user 24. Thus, the fluid soap 36 washes and sanitizes the user 24. The mitt 12 is discarded when the user 24 is washed. Thus, the mitt 12 inhibits cross contamination between patients in the medical environment. Moreover, the sheet 38 inhibits cross contamination between the caregiver and a patent.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bodily washing assembly being configured to be worn on a user's hand thereby facilitating the user to wash the user's body in a medical environment, said assembly comprising:

a mitt being configured to be worn on a hand, said mitt having a bottom wall, said bottom wall having an outer surface; and a cleaning unit being coupled to said mitt wherein said cleaning unit is configured to wash the user when the user wears said mitt, said cleaning unit containing a fluid soap wherein said fluid soap is configured to be dispensed onto the user, said cleaning unit including a sheet being coupled to said outer surface of said bottom wall, said sheet being coextensive with said bottom wall, said sheet being comprised of a fluid impermeable material, said sheet having a first surface and a second surface, said first surface engaging said outer surface of said bottom wall; and a panel having a primary surface and a secondary surface, said primary surface being coupled to said second surface of said sheet, said panel being coextensive with said sheet, said panel having an opening extending through said primary surface and said secondary surface to define a soap space, said fluid soap being positioned in said soap space, said opening having a bounding edge, said opening being positioned closer to a front side of said mitt than a back side of said mitt.

2. The assembly according to claim 1, wherein said mitt has a top wall and a peripheral edge extending therebetween, said peripheral edge having a front side and a back side, said back side being open wherein said back side is configured to insertably receive a hand of a user having said bottom wall being positioned on a palm of the user.

3. The assembly according to claim 1, further comprising a sponge having a first surface, a second surface and an exterior edge extending therebetween, said exterior edge being coextensively coupled to said bounding edge of said opening having said first surface of said sponge being spaced from said second surface of said sheet.

4. The assembly according to claim 3, wherein said fluid soap is absorbed through said first surface and said second surface when said mitt is worn wherein said sponge is configured to selectively dispense the fluid soap onto the user's body.

5. A bodily washing assembly being configured to be worn on a user's hand thereby facilitating the user to wash the user's body in a medical environment, said assembly comprising:

a mitt being configured to be worn on a hand, said mitt having a top wall, a bottom wall and a peripheral edge extending therebetween, said peripheral edge having a front side and a back side, said back side being open wherein said back side is configured to insertably receive a hand of a user having said bottom wall being positioned on a palm of the user, said bottom wall having an outer surface; and a cleaning unit being coupled to said mitt wherein said cleaning unit is configured to wash the user when the user wears said mitt, said cleaning unit containing a fluid soap wherein said fluid soap is configured to be dispensed onto the user, said cleaning unit comprising:

a sheet being coupled to said outer surface of said bottom wall, said sheet being coextensive with said bottom wall, said sheet being comprised of a fluid impermeable material, said sheet having a first surface and a second surface, said first surface engaging said outer surface, a panel having a primary surface and a secondary surface, said primary surface being coupled to said outer surface of said sheet, said panel being coextensive with said sheet, said panel having an opening extending through said primary surface and said secondary surface to define a soap space, said fluid soap being positioned in said soap space, said opening having a bounding edge, said opening being positioned closer to said front side of said mitt than said back side of said mitt, and a sponge having a first surface, a second surface and an exterior edge extending therebetween, said exterior edge being coextensively coupled to said bounding edge of said opening having said first surface of said sponge being spaced from said second surface of said sheet, said fluid soap being absorbed through said first surface and said second surface when said mitt is worn wherein said sponge is configured to selectively dispense the fluid soap onto the user.

* * * * *